US010130139B2

(12) United States Patent
Parke

(10) Patent No.: US 10,130,139 B2
(45) Date of Patent: Nov. 20, 2018

(54) ORTHOTIC INSOLE FOR A WOMAN'S SHOE

(71) Applicant: MARION PARKE DESIGNS, LLC, Minneapolis, MN (US)

(72) Inventor: Marion Garrett Parke, Minneapolis, MN (US)

(73) Assignee: Marion Parke Designs, LLC, Minneapolis, MN (US)

( * ) Notice: Subject to any disclaimer, the term of this patent is extended or adjusted under 35 U.S.C. 154(b) by 64 days.

(21) Appl. No.: 14/553,275

(22) Filed: Nov. 25, 2014

(65) Prior Publication Data

US 2016/0143393 A1 May 26, 2016

(51) Int. Cl.
*A43B 7/14* (2006.01)

(52) U.S. Cl.
CPC ..... *A43B 7/143* (2013.01); *A43B 7/141* (2013.01); *A43B 7/142* (2013.01)

(58) Field of Classification Search
CPC ..... A43B 13/386; A43B 13/38; A43B 17/006; A43B 17/003; A43B 17/14; A43B 7/142; A43B 7/143; A43B 7/14; A43B 7/141; A43B 7/1405; A43B 7/1445; A43B 7/149
USPC ..... 36/43, 44, 91, 108, 76 R, 143, 144, 145, 36/159, 166, 182, 181, 180, 172
See application file for complete search history.

(56) References Cited

U.S. PATENT DOCUMENTS 2,009,789 A 7/1935 Saladino
2,343,790 A 3/1944 Nicholl
2,366,096 A * 12/1944 Gerber ..... A43B 7/14 36/155
2,413,534 A 12/1946 Watson
2,447,954 A 8/1948 Meldman
2,672,698 A 3/1954 Watson
2,878,593 A 3/1959 Lockridge
2,917,757 A * 12/1959 Scholl ..... A43B 7/28 12/146 M
3,170,178 A * 2/1965 Scholl ..... A43B 7/1415 12/142 R (Continued)

FOREIGN PATENT DOCUMENTS

GB 404406 1/1934

OTHER PUBLICATIONS

International Search Report and Written Opinion for International Patent Application No. PCT/US2015/060585; dated Jan. 29, 2016.

*Primary Examiner* — Megan E Lynch
(74) *Attorney, Agent, or Firm* — Barnes & Thornburg LLP; Jason Bernstein

(57) ABSTRACT

A women's high-heel shoe and a non-removable insole to be incorporated therein, the insole having an arch fill, a 3-degree rearfoot post and a layer of a closed-cell foam material, such as ethylene vinyl acetate. The arch support extends below the arch and may be positioned along an inside edge of the insole. The 3-degree rearfoot post is configured to extend below an outside edge of a user's foot. The rearfoot post may be integral to the bottom layer of the insole and have a durometer of approximately 55. The rearfoot post may extend the full length of the insole but may have a width that is substantially smaller than the width of the insole. The insole may extend varying lengths, including the full length of the sole of the shoe or to a location adjacent a user's digital sulcus.

36 Claims, 6 Drawing Sheets

(56) References Cited

U.S. PATENT DOCUMENTS 3,292,277 A 12/1966 Teschon
3,344,537 A * 10/1967 Diamant ..... A43B 3/00 36/44
3,398,469 A * 8/1968 Bressan ..... A43B 3/128 36/11.5
3,442,031 A 5/1969 Antell
3,828,792 A * 8/1974 Valenta ..... A43B 7/14 36/178
4,563,787 A 1/1986 Drew
4,633,877 A * 1/1987 Pendergast ..... A43B 7/14 36/140
4,942,679 A 7/1990 Brandon et al.
5,036,603 A * 8/1991 Dischler ..... A43B 17/14 36/43
5,138,774 A * 8/1992 Sarkozi ..... A43B 7/14 36/159
5,164,878 A 11/1992 Hauser
5,184,409 A * 2/1993 Brown ..... A43B 7/142 36/173
D353,259 S 12/1994 Schroer, Jr.
5,724,753 A * 3/1998 Throneburg ..... A43B 7/142 36/10
5,733,647 A * 3/1998 Moore, III ..... A43B 7/144 36/43
5,901,394 A * 5/1999 Greenawalt ..... A43B 3/128 12/142 N
5,976,100 A * 11/1999 Greenawalt ..... A43B 1/0054 36/43
6,000,147 A * 12/1999 Kellerman ..... A43B 7/142 36/160
6,176,025 B1 * 1/2001 Patterson ..... A43B 5/001 36/28
6,484,419 B1 * 11/2002 Rohde ..... A43B 7/141 36/10
6,510,626 B1 * 1/2003 Greenawalt ..... A43B 7/142 36/160
6,560,902 B1 * 5/2003 Eschweiler ..... A43B 7/141 36/154
D571,989 S 7/2008 Siegal
D668,849 S 10/2012 Pozzi
D668,850 S 10/2012 Pozzi
D701,028 S 3/2014 Remington et al.
8,800,170 B1 * 8/2014 Khaitan ..... A43B 17/026 36/28
9,215,908 B1 * 12/2015 Malmoux ..... A43B 17/003
2003/0105193 A1 * 6/2003 Wang ..... A43B 7/28 524/81
2004/0181971 A1 * 9/2004 Turkbas ..... A43B 7/141 36/44
2004/0211086 A1 * 10/2004 Dananberg ..... A43B 7/14 36/11.5
2005/0000114 A1 * 1/2005 Mick ..... A43B 3/0084 36/11.5
2005/0138844 A1 * 6/2005 Johnson ..... A43B 7/142 36/44
2005/0281988 A1 * 12/2005 McCormick ..... A41D 31/0038 428/190
2006/0156583 A1 * 7/2006 Butash ..... A43B 13/386 36/44
2006/0288613 A1 * 12/2006 Lo ..... A43B 7/1415 36/44
2007/0011918 A1 1/2007 Snow et al.
2007/0084084 A1 * 4/2007 Rich ..... A43B 7/142 36/44
2007/0107261 A1 * 5/2007 Cheskin ..... A43B 7/141 36/44
2008/0052963 A1 * 3/2008 Chiang ..... A43B 3/108 36/91
2008/0127527 A1 * 6/2008 Chen ..... A43B 13/12 36/3 B
2008/0148599 A1 * 6/2008 Collins ..... A43B 7/28 36/44
2009/0007455 A1 1/2009 Montgomery
2009/0049712 A1 * 2/2009 Steszyn ..... A43B 7/142 36/91
2009/0282705 A1 * 11/2009 Trigillo ..... A43B 7/142 36/3 B
2010/0064550 A1 * 3/2010 Kahn ..... A43B 3/0031 36/91
2010/0122475 A1 * 5/2010 Purrington ..... A43B 17/14 36/3 B
2010/0180467 A1 7/2010 Singleton
2010/0275468 A1 * 11/2010 Shelton ..... A43B 7/141 36/3 B
2011/0061264 A1 * 3/2011 Solymosi ..... A43B 7/142 36/88
2011/0209360 A1 * 9/2011 Baker ..... A43B 7/1435 36/44
2011/0219642 A1 * 9/2011 Sulak ..... A43B 7/141 36/44
2012/0174436 A1 * 7/2012 Hanak ..... A43B 7/142 36/43
2012/0304493 A1 * 12/2012 Hudson ..... A43B 7/28 36/83
2013/0008050 A1 * 1/2013 Marc ..... A43B 17/026 36/44
2013/0081306 A1 * 4/2013 Park ..... A43B 7/1425 36/43
2013/0263470 A1 * 10/2013 Durocher ..... A43B 7/142 36/43
2014/0209229 A1 * 7/2014 Yang ..... A43B 19/00 156/60
2014/0245631 A1 * 9/2014 Joseph ..... A43B 1/0027 36/44
2014/0250722 A1 * 9/2014 Lin ..... A43B 7/142 36/44
2015/0026998 A1 * 1/2015 Lin ..... A43B 7/144 36/44

* cited by examiner

ORTHOTIC INSOLE FOR A WOMAN'S SHOE

FIELD

The present disclosure generally relates to an orthotic insole for a woman's shoe. More particularly, exemplary embodiments of the present disclosure relate to a built-in, orthotic insole for a women's high heel or elevated shoe.

BACKGROUND AND SUMMARY

The following presents a simplified background and summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

Women's shoes, and in particular women's high-heel shoes, can cause various concerns for a wearer that create or exacerbate physical or medical issues relating to the wearer's foot and ankle. Extended wear of a high heel can cause a range of ailments, including for example, damage to the ankle, leg tendons, and foot tendons, or issues in the legs and back due to improper distribution of the wearer's weight. High-heeled shoes tend to put a foot in a plantarflexed (foot pointed downward) position, shifting the body weight away from the heel to the balls of the foot. When a woman wears high heels, her arch height is increased, which alters her posture and gait. Furthermore, an increased arch height can lead to an unnatural increase in pressure to other areas of the foot, muscle fatigue and foot and ankle injury. High heel shoes also cause a wearer's foot and ankle to move in a supinated (turned outward) position. Thus, as it is well known, wearing high heel shoes can lead to an increased risk of ankle sprain or falls due to imbalance.

In illustrative embodiments, a built-in, orthotic insole for a women's high-heel or elevated shoe is provided that may limit or counteract some of the issues that may be more prevalent for women wearing high heels. In illustrative embodiments, the orthotic insole may be comprised of three layers of material, with the inner layer including a closed-cell foam material, such as, but not limited to ethylene vinyl acetate. In illustrative embodiments, this material commercially available as P-Cell® or a similar material that has an approximate durometer of 20. The insole may further comprise an arch fill or arch support. The arch fill may consist of Microcell Puff™ or other similar material that has an approximate durometer of 35, in illustrative embodiments. The arch support may be configured to approximately extend laterally below the base of the forth metatarsal bone of the user of the high-heel shoe. The insole further includes a rear foot post or posting, which in illustrative embodiments may be made of ethylene vinyl acetate with a durometer of approximately 55, that is a 3-degree post. In illustrative embodiments, the insole may be a full-length insole, or may be a sulcus-length insole that extends to approximately the digital sulcus of a user's foot. In illustrative embodiments, the high-heel shoe also comprises a heel counter. The features minimize the risk of the user's foot sliding forward into a toe box of the shoe (for instance, when the heel of the high-heel shoe is 4 inches or less).

While the insole is configured to be permanently fixed in the high-heel shoe, the shape and size of the insole may be modified based on the shape and size of the shoe. The insole may further be covered in a wrap of leather or other similar material before being inserted into the shoe. Given the cosmetic element desired when wearing high heels, the non-removable insole may be covered in the same fabrics and materials as the upper part of the shoe. In such a manner, the wrapped insole avoids showing unattractive adhesive pads and also eliminates slippage of such removable pads.

BRIEF DESCRIPTION OF THE DRAWINGS

The drawings disclose exemplary embodiments in which like reference characters designate the same or similar parts throughout the figures of which.

DETAILED DESCRIPTION

Unless otherwise indicated, the drawings are intended to be read (for example, cross-hatching, arrangement of parts, proportion, degree, or the like) together with the specification, and are to be considered a portion of the entire written description. As used herein, the terms "horizontal", "vertical", "left", "right", "bottom", "middle", "top", "up" and "down", as well as adjectival and adverbial derivatives thereof (for example, "horizontally", "rightwardly", "upwardly", or the like), simply refer to the orientation of the illustrated structure as the particular drawing figure faces the reader.

Figure 1:
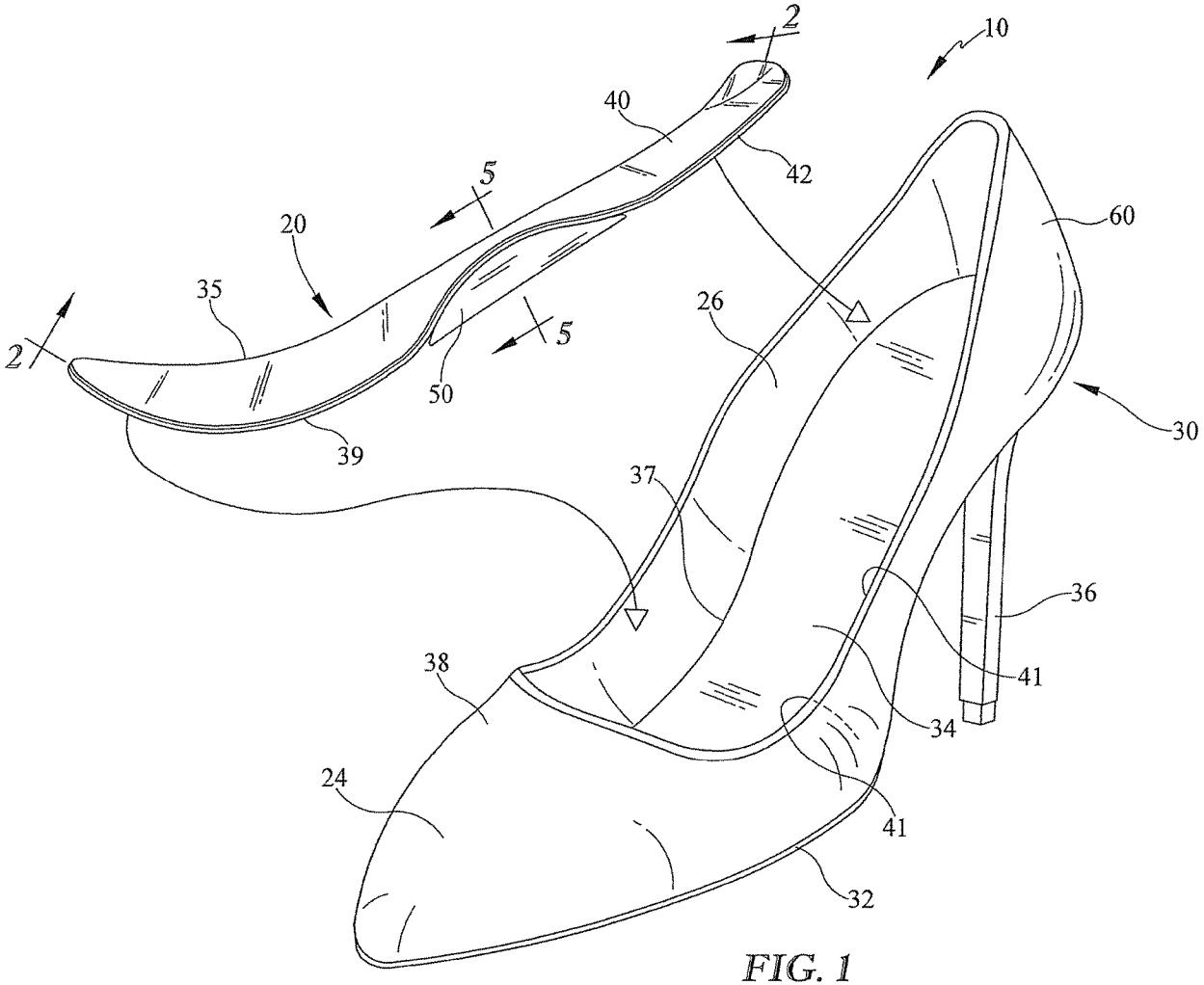
FIG. 1 is a disassembled view of a women's right high heel shoe with a full-length orthotic insole according to an exemplary embodiment.

In exemplary embodiments, as shown in FIGS. 1-6, a women's shoe 10 generally includes an insole or insert 20 and a shoe base 30. The women's shoe 10 is configured to be a heeled or elevated shoe such that the shoe base 30 includes a sole 32, a heel 36 coupled on the bottom of the sole 32, and an upper portion 38 (which may include a quarter or vamp portion) that extends upward from the sole 32 away from the heel 36, as illustrated in FIG. 1. The upper portion 38 may include a toe box 24 that surrounds and contains a user's toes (not shown) when the user is wearing the women's shoe 10. The heel 36 may be configured to be similar to heels of other women's shoes as known in the industry.

Figure 4:
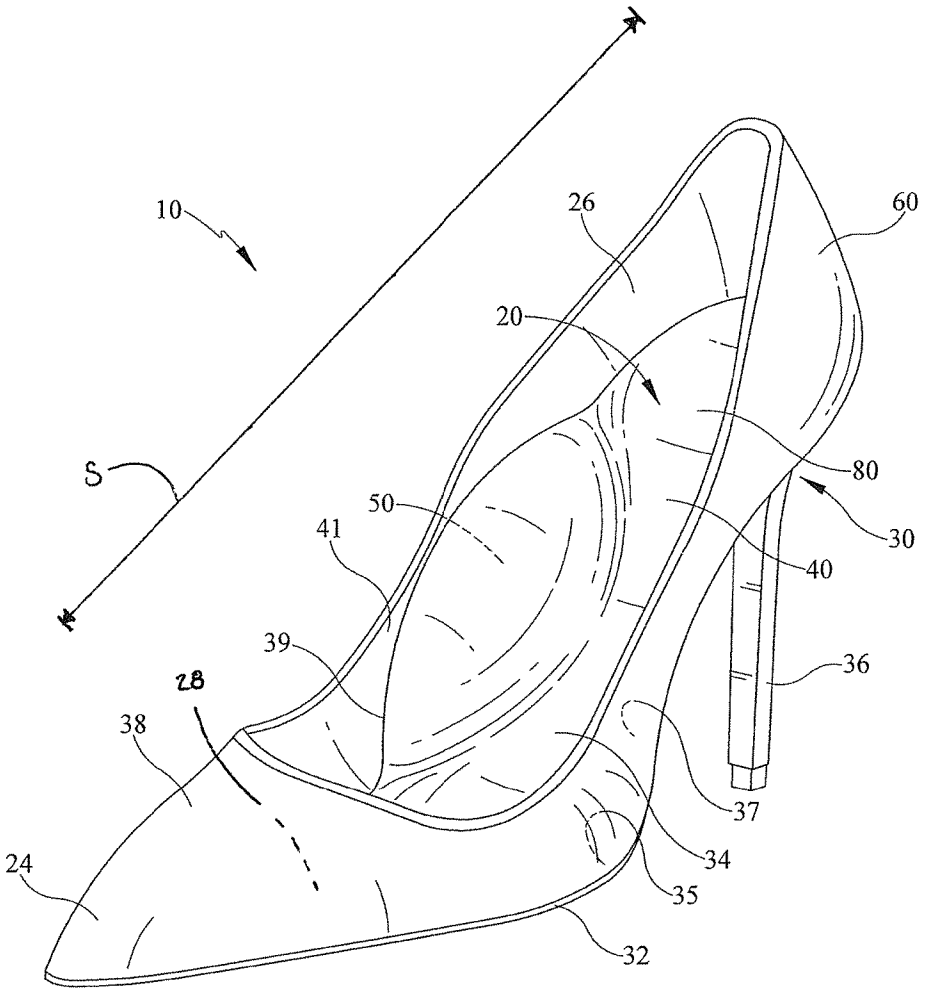
FIG. 4 is an assembled view of an exemplary women's left high heel shoe and a full-length, wrapped orthotic insole according to an exemplary embodiment.
Figure 6:
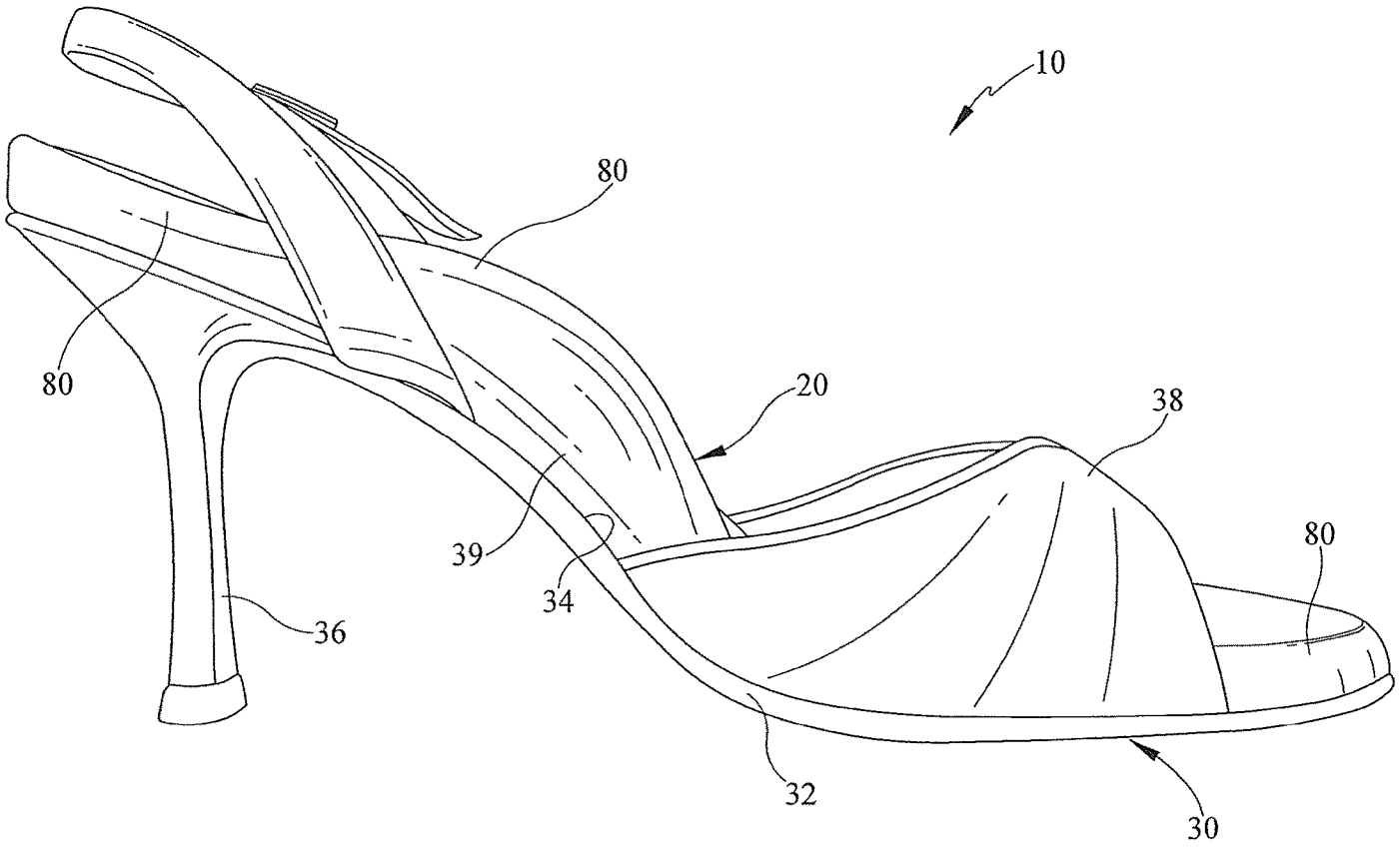
FIG. 6 is an assembled view of an alternative example of a women's high heel shoe including a full length, wrapped orthotic insole according to an exemplary embodiment.

The insole 20 is configured to be permanently affixed in the shoe base along a top surface 34 of the sole 32 of the shoe base 30, as illustrated in FIGS. 1, 4 and 6. As illustrated in the exemplary embodiments, the insole 20 may be generally shaped to conform to a bottom surface of a person's foot (not shown). It is desirable that the insole 20 is of sufficient thickness and of appropriate durometer to be suitable under the stresses accompanying ordinary use of the women's shoe 10. Moreover, the insole 20 should be sufficiently flexible to permit movement during flexing of the foot and to accommodate multiple arch heights in the women's shoe 10. The insole 20 may be covered in a wrap 80 that substantially surrounds at least the top of the insole 20 for cosmetic and comfort of the user. In illustrative embodiments, the wrap 80 may also surround the sides and/or a portion of the bottom of the insole for cosmetic purposes, as illustrated in FIG. 6. In illustrative embodiments, the wrap 80 may be made of leather or other similar material, and may be created to match or coordinate with other portions of the shoe 10.

The insole 20 may be configured to extend varying lengths of the shoe base 30. For instance, the insole 20 may extend the full length of the sole 32, as shown in FIGS. 1-6. Alternatively, the insole 20 may be a sulcus-length insole (not shown), extending to a location adjacent to where a user's digital sulcus may be positioned. Other insole lengths that permit incorporation of the features herein described are also envisioned. Further, the present disclosure envisions that the shape, size and type of the insole 20 may be modified based on the shape, size and type of the shoe 10 that it will be incorporated into.

Figure 2:
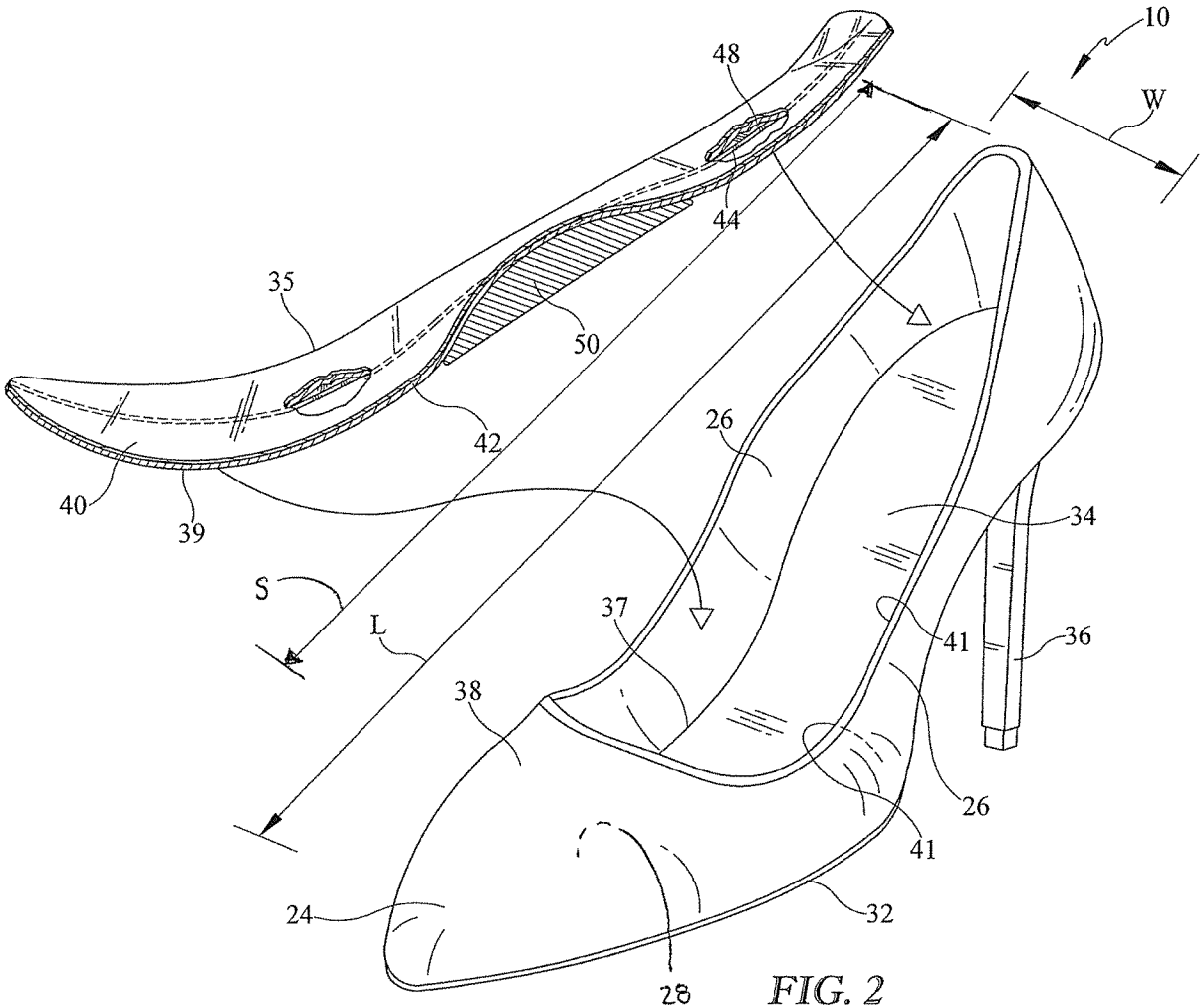
FIG. 2 is the disassembled view of FIG. 1 further showing a cross-sectional view of the orthotic insole taken along the line 2-2 in FIG. 1.

In illustrative embodiments, the insole 20 may extend substantially the full length L of the sole 32 and span the full width W of the sole 32; that is, the insole 20 may be a heel-to-toe and side-to-side insole as illustrated in FIGS. 1, 2 and 4. The insole 20 may be configured to fit within, and to extend substantially between, one or more walls 26 of the upper portion 38 of the shoe 10. Accordingly, in such an embodiment, the insole 20 substantially provides complete separation between the wearer's foot and the sole 32. In alternative embodiments, a sulcus-length insole may extend approximately a length S from the back of the sole 32 adjacent the heel 36 to a point 28 on the sole 32, as illustrated in FIGS. 2 and 4, the point 28 positioned approximately where the user's digital sulcus may be aligned when the user wears the shoe 10.

Figure 3:
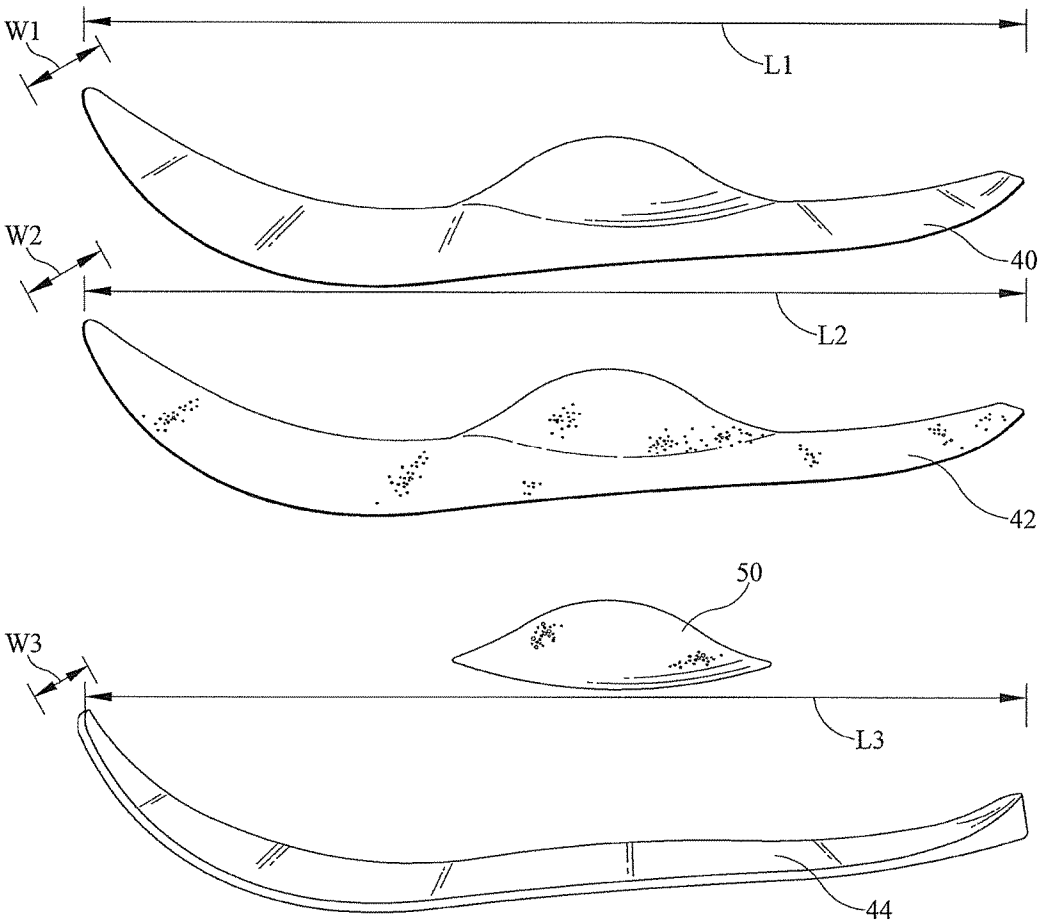
FIG. 3 is an exploded view of a full-length orthotic insole according to an exemplary embodiment.

In illustrative embodiments, the insole 20 comprises at least a top layer 40, a middle layer 42, and a bottom layer 44, as shown in FIGS. 2-3. In use, the top layer 40 is configured to be in contact with a wearer's foot (not shown), or the wrap 80 of material may be positioned between the top layer 40 and the wearer's foot. The middle layer 42 is positioned between the top layer 40 and the bottom layer 44, and the bottom layer 44 is configured to be adjacent to the sole 32 of the shoe 10. Each of these layers 40, 42, and 44 may be manufactured separately and assembled together to form the insole 20. Each layer may be contoured to meet the shape and size of a typical underside of a foot, as illustrated in the Figures.

While it is envisioned that the layers 40, 42, and 44 may be made of various materials, in illustrative embodiments, the top layer 40 may be constructed of a garment quality leather, or similar durable and resistant material. The middle layer 42 may be constructed of a closed-cell foam material, such as, but not limited to, ethylene vinyl acetate (EVA), commercially available as P-Cell®, or polyethylene, available commercially as Plastazote®. Other foam or cushioned materials may be used in various exemplary embodiments disclosed herein. Such material should provide adequate cushioning and shock absorption, while having a high coefficient of friction to provide a secure grip. A closed-cell material may also prevent irritation to a wearer as it is less abrasive from other materials. The bottom layer 44 may be constructed of a foam material, such as a closed-cell foam material, for example, ethylene vinyl acetate.

In illustrative embodiments, the top layer 40 may be configured to have a length L1 and a width W1, the length L1 being substantially similar to the length L of the insole 20 and the width W1 being substantially similar to the width W of the insole 20.

In various embodiments, the middle layer 42 may be approximately ⅛ inches thick, and have a durometer measurement of approximately 20. The middle layer 42 may have a length L2 and a width W2. The length L2 may be substantially similar to the length L of the insole 20 and length L1 of the top layer 40, and the width W2 may be substantially similar to the width W of the insole 20 and the width W1 of the top layer 40. The middle layer 42 may be configured to make the insole 20 moldable to each individual's foot, while the middle layer 42 may still be very light weight. In various embodiments, the middle layer 42 may have varying thickness along the length L2 of the middle layer 42. In addition, the middle layer 42 is envisioned to be fairly resistant to deformation, minimally abrasive, deflective of moisture, and a higher tensile strength.

Figure 5:
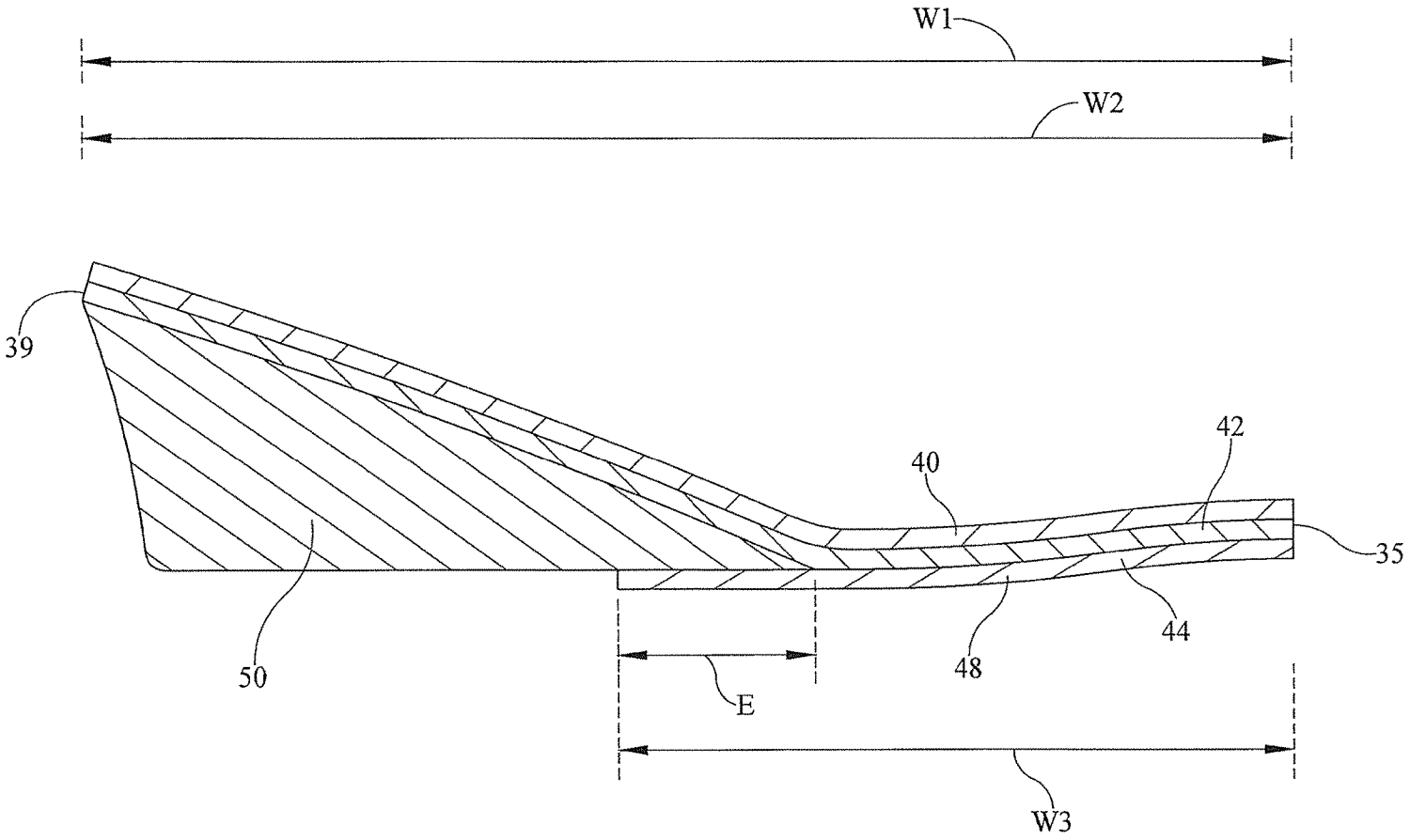
FIG. 5 is a cross-sectional view of the orthotic insole taken along the line 5-5 in FIG. 1.

The bottom layer 44 may have a length L3 that is substantially similar to lengths L, L1, and L2 of the insole 20, top layer 40, and middle layer 42, respectively. However, the bottom layer 44 may include a width W3 that is smaller than the widths W, W1 and W2 of the insole 20, top layer 40, and middle layer 42, respectively. As illustrated in FIGS. 2, 3 and 5, the width W3 may be approximately equal to, or less than half of, the width W of the whole insole 20. In illustrative embodiments, the width W3 is configured to extend and cover the lateral column of a wearer's foot (not shown). The bottom layer 44 lay be positioned along an outside edge 35 of the insole 20, the outside edge 35 corresponding to the outside of a wearer's foot (not shown) and an outer side 37 of the upper portion 38 of the shoe base 30.

The bottom layer 44 may be configured to be a more rigid than the middle layer 42, and may have a durometer of 55, which may provide more motion control. In illustrative embodiments, the bottom layer 44 may be 1/16 inches thick.

In illustrative embodiments, the bottom layer 44 comprises a rearfoot post 48, as illustrated in FIG. 3. In illustrative embodiments, the rearfoot post 48 is a lateral rearfoot post. The rearfoot post 48 is configured to provide balance to the foot and ankle of the wearer, and to further reduce lateral column overload of the foot. In an illustrative embodiment and for purposes of a women's high-heel shoe 10, the rearfoot post 48 may be a 3-degree post as known to be determined in the industry. A 3-degree rearfoot post is a biomechanically accepted rearfoot wedge size tolerated by most people to discourage the subtalar and ankle joints from inverting, by directing ground reactive forces laterally. Such a design reduces the tendency to twist or sprain an ankle. This feature is helpful in combination with a high-heel shoe, as the heel causes the arch to elevate naturally. The rearfoot post 48 may be positioned along the sole 32 and extend the length L of the insole 20 from the heel 36 of the shoe base 30. The rearfoot post 48 may be configured as a wedge of orthotic material added to control excess rearfoot frontal plane movement.

The insole 20 further includes an arch fill 50, as illustrated in FIGS. 1-4. The arch fill 50 is not the full length of the insole 20, but rather is only configured to be positioned under a wearer's arch along an inner edge 39 of the insole 20 and adjacent to an inner side 41 of the upper portion 38 of the shoe base 30. In illustrative embodiments, the arch fill 50 may be made of Microcell Puff, an ethylene vinyl acetate foam, or other similar material, and may be of variable measurements based on the shoe size. The arch fill 50 may have a durometer measurement of 35. The arch fill 50 may be configured for some flexibility while also providing rigidity and resistance to deformation.

In illustrative embodiments, the bottom layer 44 of the insole 20 may partially overlap the arch fill 50, as illustrated in FIG. 5. The bottom layer 44 may extend under the lateral column of the wearer, while the arch fill 50 extends below at least the entire arch of the wearer. In this manner, the bottom layer 44 may extend over a portion of the arch fill 50 by a length of E, as illustrated in FIG. 5.

In illustrative embodiments, the upper portion 38 of the shoe 10 may further include a heel counter 60. The heel counter 60 is an upwardly extending support on the back of the upper portion 38 above the heel 36. The heel counter 60 provides support for the heel of the wearer of the shoe 10 by wrapping around a portion of the wearer's heel and/or ankle, as illustrated in FIGS. 1 and 4. The heel counter 60 is configured to be similar to heel counters known in the industry.

The combination of the arch fill 50 and rearfoot post 48 together provide an appropriate support for the foot and ankle of the wearer of the high-heel shoe 10. Specifically, the addition of the arch fill 50 provides a natural support for a wearer's arch (both natural and created from the high-heel shoe), which the rearfoot post 48 provides a counter-balance to the forces on the wearer's ankle and heel that can cause ankle sprains or injuries. These features in combination provide beneficial support for high-heel shoes.

In illustrative embodiments, this combination may be enhanced with the heel counter 60. In combination with a heel counter 60 that restricts movement of the wearer's foot and ankle in the shoe 10, the features of the present disclosure provide additional beneficial support for high-heel shoes.

One exemplary embodiment of a method of making an insole 20 for a women's high-heel shoe 10 includes providing a first layer 44 of crepe or similar durometer material, a second layer 42 of a closed-cell ethylene vinyl acetate (EVA) foam material, and a third layer 40 of garment quality leather or other durable material to form an insole 20. The first layer 44 is configured to include a rearfoot posting 48 that provides a 3-degree wedge to diminish or prevent lateral column loading to the wearer's foot. The first layer 44 may be configured to have a smaller width W3 than the second layer 42 of the insole 20 such that the first layer 44 only extends to cover the width of a wearer's lateral column, while the width W2 of the second layer 42 may extend the entire width W of a wearer's foot. In between the first and second layers 44 and 42, there may be an arch support 50, the arch support 50 being positioned to be aligned with the arch of a user wearing the high-heel shoe 10. In this manner, the arch support 50 is positioned on the inner edge 39 of the insole 20, while the first layer 44 is positioned on the outer edge 35 of the insole 20 and partially overlaps the arch support 50. The third layer 40 of the insole 20 may be substantially the same size and shape as the second layer 42. The insole 20 may be combined with a shoe base 30 that includes a heel counter 60 along the back of the shoe base 30, the heel counter 60 restraining movement of the wearer's heel while the wearer's foot is in the shoe 10.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. It is intended that the specification and examples be considered as exemplary only, with a true scope and spirit being indicated by the following inventive concepts.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

The headings of various sections are used for convenience only and are not intended to limit the scope of the present disclosure.

Throughout the description and claims of this specification, the word "comprise" and variations of the word, such as "comprising" and "comprises," means "including but not limited to," and is not intended to exclude, for example, other additives, components, integers or steps. "Exemplary" or "illustrative" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc., of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

It should further be noted that any patents, applications and publications referred to herein are incorporated by reference in their entirety.

The invention claimed is:

1. A high-heel shoe, comprising:

an insole having a lateral edge and a medial edge, both the lateral edge and the medial edge extending between a terminal toe edge of the insole and a terminal heel edge of the insole, the terminal heel edge being positioned below a heel of a user wearing the shoe, and the insole having a first length that is substantially the full length of a sole of the shoe, the insole comprising:

an arch fill, the arch fill configured to extend below the arch of the user wearing the high-heel shoe and configured to be positioned substantially adjacent the medial edge of the insole, the arch fill configured to have a width that is less than a width of the insole at any identified point along the first length of the insole;

a lateral rearfoot post positioned along the lateral edge of the insole, wherein the lateral rearfoot post has a length that is substantially the same as the first length of the insole and extends to the terminal heel edge of the insole, and the lateral rearfoot post has a width that is equal to or less than half of the width of the insole such that the lateral rearfoot post does not extend to the medial edge of the insole, the width of the rearfoot post being substantially the same along the entire length of the rearfoot post; and a layer of a foam material that has a length that is substantially the same as the first length of the insole and a width that is substantially the same as the width of the insole;

wherein the insole is permanently affixed inside the high-heel shoe to a sole or base of the high-heel shoe, wherein the insole comprises a top layer, a middle layer comprising the layer of foam material, and a bottom layer comprising the rearfoot post.

2. The high-heel shoe of claim 1, wherein the arch fill is configured to approximately extend laterally below a base of a forth metatarsal bone of the user's foot.

3. The high-heel shoe of claim 1, wherein the rearfoot post overlaps the arch fill vertically within the insole.

4. The high-heel shoe of claim 1, wherein the arch fill is made of a foam material with a durometer of approximately 35.

5. The high-heel shoe of claim 1, wherein the top layer is made of leather and the bottom layer is made of acetate closed-cell foam material.

6. The high-heel shoe of claim 5, wherein the middle layer is made of a foam material with a durometer of approximately 20.

7. The high-heel shoe of claim 5, wherein the bottom layer has a durometer of approximately 55.

8. The high-heel shoe of claim 1, wherein the lateral rearfoot post is configured to overlap with the arch fill in the insole.

9. The high-heel shoe of claim 1, wherein the arch fill is configured to approximately extend laterally below a base of a forth metatarsal bone of the user's foot.

10. The high-heel shoe of claim 1, wherein the bottom layer comprises the rearfoot post and the arch fill.

11. The high-heel shoe of claim 1, wherein the layer of foam material is ⅛ inch thick.

12. The high-heel shoe of claim 1, wherein the layer of foam material is a closed-cell foam material selected from the group consisting of ethylene vinyl acetate and polyethylene.

13. The high-heel shoe of claim 12, wherein the insole comprises a layer of leather above the layer of foam material, the arch fill below the layer of foam material, and the rearfoot post forms an additional layer made of closed-cell foam material below the layer of foam material.

14. The high-heel shoe of claim 13 wherein the durometer of the layer of foam material is approximately 20.

15. The high-heel shoe of claim 13, wherein the durometer of the rearfoot post is approximately 55.

16. The high-heel shoe of claim 1, wherein the shoe further comprises a heel counter.

17. The high-heel shoe of claim 1, wherein a wrap extends substantially around a top of the insole.

18. The high-heel shoe of claim 1, wherein the insole is a full-length insole.

19. The high-heel shoe of claim 1, wherein the insole is a sulcus-length insole.

20. A method of making a high-heel shoe, comprising:

providing a bottom layer of acetate closed cell foam material to create a rearfoot posting that has a length substantially equal to a length of an inside of the high-heel shoe and has a width that is equal to or less than half a width of the inside of the high-heel shoe, the rearfoot posting positioned along a lateral edge of the high-heel shoe but not extending to a medial edge of the high-heel shoe and extending to a heel terminal edge of the shoe that corresponds with a heel of the user wearing the shoe, the width of the rearfoot post being substantially the same along the entire length of the rearfoot post;

providing a middle layer of a closed-cell foam material that has a length that is substantially the same as the length of the bottom layer and has as width that is substantially the same as the width of the inside of the high-heel shoe;

providing an arch support between the middle layer and the bottom layer, the arch support positioned to be generally aligned with an arch of a user wearing the high-heel shoe and along a medial edge of the high-heel shoe and having a width that is less than the width of the inside of the high-heel shoe at any point along the length of the inside of the high-heel shoe;

providing a top layer of leather that is substantially the same size and shape as the middle layer; and combining the top layer, middle layer, arch support and bottom layer together to form an insole to be permanently affixed in the high-heel shoe.

21. The method of claim 20, wherein the arch support is configured to approximately extend laterally below a base of a forth metatarsal bone of the user's foot.

22. The method of claim 21, wherein the middle layer is made of a closed-cell foam material having a durometer of approximately 20.

23. The method of claim 20, wherein the middle layer is ⅛ inch and has a durometer of approximately 20.

24. The method of claim 20, wherein the method further comprises providing a wrap that extends substantially around a top and one or more sides of the insole.

25. The method of claim 20, wherein the method further comprises providing a closed toe box for the high-heel shoe.

26. The method of claim 25, wherein the arch support is configured to minimize risk of a user's foot sliding forward into the toe box of the high-heel shoe.

27. The method of claim 20, wherein the method further comprises providing a heel counter in the high-heel shoe.

28. An insole for a shoe, comprising:

an arch fill configured to extend below an arch of a user wearing the shoe and configured to be positioned substantially adjacent to an interior edge of the insole;

a lateral rearfoot post separate from the arch fill, the lateral rearfoot post configured to be positioned substantially along an outside edge of the insole, a portion of the rearfoot post underlying a portion of the arch fill wherein the rearfoot post does not extend to the interior edge of the insole; and, a layer of a foam material positioned above a portion of the arch fill, wherein the insole has a toe terminal edge and a heel terminal edge, the heel terminal edge being positioned below a heel of the user wearing the shoe, the insole having a length extending from the toe terminal edge to the heel terminal edge and being substantially the full length of a sole of the shoe, and the arch fill has a width that is less than a width of the insole at any point along the length of the insole, and, wherein the rearfoot post has a length that is substantially the same as the length of the insole and extends to the heel terminal edge of the insole, the rearfoot post further having a width that is equal to or less than half of the width of the insole, and the width of the rearfoot post being substantially the same along the entire length of the rearfoot post.

29. The insole of claim 28, wherein the arch fill is configured to approximately extend laterally below a base of a forth metatarsal bone of the user's foot.

30. The insole of claim 28, wherein the durometer of the rearfoot post is approximately 55.

31. The insole of claim 28, wherein the insole further comprises a layer of leather above the layer of foam material.

32. The insole of claim 28, wherein a wrap extends substantially around a top and one or more sides of the insole.

33. The insole of claim 28, wherein the layer of foam material is a closed-cell foam material selected from the group consisting of ethylene vinyl acetate and polyethylene.

34. The insole of claim 28, wherein the layer of foam material is a material selected from the group consisting of ethylene vinyl acetate and polyethylene.

35. The insole of claim 28, wherein the insole is configured to extend substantially a length of a distance of a user's heel to a user's digital sulcus.

36. The insole of claim 28, wherein the insole is configured to extend substantially a length of the user's foot.

* * * * *